US009322267B2

(12) United States Patent
Pop et al.

(10) Patent No.: US 9,322,267 B2
(45) Date of Patent: Apr. 26, 2016

(54) DOWNHOLE SAMPLING OF COMPRESSIBLE FLUIDS

(71) Applicant: Schlumberger Technology Corporation, Sugar Land, TX (US)

(72) Inventors: Julian Pop, Houston, TX (US); Pierre Henri Campanac, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 444 days.

(21) Appl. No.: 13/801,046

(22) Filed: Mar. 13, 2013

(65) Prior Publication Data

US 2014/0166269 A1 Jun. 19, 2014

Related U.S. Application Data

(60) Provisional application No. 61/738,856, filed on Dec. 18, 2012.

(51) Int. Cl.
*E21B 49/08* (2006.01)
*E21B 49/10* (2006.01)

(52) U.S. Cl.
CPC ..... *E21B 49/082* (2013.01); *E21B 49/10* (2013.01)

(58) Field of Classification Search
CPC .. E21B 49/082; E21B 49/10; E21B 2049/085
See application file for complete search history.

(56) References Cited

U.S. PATENT DOCUMENTS 4,527,953 A 7/1985 Baker et al.
4,860,581 A 8/1989 Zimmerman et al.
5,377,755 A * 1/1995 Michaels et al. ..... 166/264
5,803,186 A * 9/1998 Berger et al. ..... 175/50
6,058,773 A 5/2000 Zimmerman et al.
6,339,886 B1 * 1/2002 Reinhardt ..... 33/544.2
6,719,049 B2 * 4/2004 Sherwood et al. ..... 166/264
6,871,713 B2 3/2005 Meister et al.
7,565,835 B2 7/2009 Bittleston et al.
7,913,556 B2 * 3/2011 Hsu et al. ..... 73/152.28
8,210,260 B2 7/2012 Milkovisch et al.
8,899,323 B2 * 12/2014 Zazovsky et al. ..... 166/264
2003/0042021 A1 * 3/2003 Bolze et al. ..... 166/264
2004/0020649 A1 2/2004 Fields
2006/0101905 A1 * 5/2006 Bittleston et al. ..... 73/152.24
2006/0243033 A1 * 11/2006 Freemark et al. ..... 73/64.45
2007/0079962 A1 * 4/2007 Zazovsky et al. ..... 166/264
2009/0049904 A1 * 2/2009 Meister ..... 73/152.23
2009/0308600 A1 * 12/2009 Hsu et al. ..... 166/250.01
2010/0175873 A1 * 7/2010 Milkovisch et al. ..... 166/264
2011/0031972 A1 * 2/2011 Pelletier et al. ..... 324/324
2012/0132419 A1 5/2012 Zazovsky et al.
2013/0081803 A1 * 4/2013 Tao et al. ..... 166/247
2013/0293891 A1 * 11/2013 Zazovsky et al. ..... 356/402

(Continued)

*Primary Examiner* — Jennifer H Gay
(74) *Attorney, Agent, or Firm* — Kenneth L. Kincaid

(57) ABSTRACT

A downhole compressible fluid sampling tool includes a primary fluid flow line deployed between a fluid inlet probe and a fluid outlet line. A fluid analysis module and a fluid pumping module are deployed in the primary fluid flow line. The fluid pumping module includes a pump in parallel with a bypass flow line having a bypass valve. A compressible fluid sampling vessel is deployed in parallel with and in fluid communication with the primary flow line. A method for obtaining a sample of a compressible downhole fluid includes turning off the pump and opening the bypass valve to enable the downhole fluid to flow into the fluid sampling vessel. The pump may then be optionally turned back on to pressurize the sample.

8 Claims, 6 Drawing Sheets

(56) References Cited

U.S. PATENT DOCUMENTS

2014/0131029 A1* 5/2014 Harms et al. ..... 166/66.4
2014/0166269 A1* 6/2014 Pop et al. ..... 166/250.01
2014/0238667 A1* 8/2014 Dumont et al. ..... 166/250.01

* cited by examiner

DOWNHOLE SAMPLING OF COMPRESSIBLE FLUIDS

CROSS REFERENCE TO RELATED APPLICATIONS

The present application claims priority to U.S. Provisional Patent Application No. 61/738,856 filed Dec. 18, 2012, the entirety of which is incorporated by reference.

FIELD OF THE INVENTION

Disclosed embodiments relate generally to sampling subterranean formation fluids and more specifically to sampling highly compressible fluids such as dry gases or ethers.

BACKGROUND INFORMATION

In order to successfully exploit subterranean hydrocarbon reserves, information about the subsurface formations and formation fluids intercepted by a wellbore is generally required. This information may be obtained via sampling formation fluids during various drilling and completion operations. The fluid may be collected and analyzed, for example, to ascertain the composition and producibility of hydrocarbon fluid reservoirs.

Downhole sampling tools commonly include a fluid entry port (or probe), a fluid inlet valve, and one or more sample chambers. Formation fluids may be pumped (e.g., using a reciprocating positive displacement pump) through fluid analysis instrumentation into a sample chamber. Such pumping methods work well with incompressible (or nearly incompressible) fluids such as those containing primarily liquid water and/or oil. However, when the formation fluid is highly compressible (such as with a gaseous fluid), positive displacement pumps tend to be inefficient as much of the stroke volume compresses and decompresses the gaseous fluid rather than pumping the fluid. Repeated compression and decompression may also result in irreversible changes to the formation fluid which compromises the integrity of the sample.

Gaseous formation fluids may also be dumped (or received) into a sample chamber using the formation pressure to drive the fluid into the chamber. However, such methodologies tend to significantly reduce the pressure of the sample, resulting in a low pressure, low mass sample. These methods can also cause irreversible changes to the fluid owing to expansion of the gas into the sample chamber.

Therefore there is a need in the art for improved formation fluid sampling tools and methods, particularly for obtaining samples of highly compressible fluids such as gases.

SUMMARY

A downhole fluid sampling tool for obtaining compressible fluid samples is disclosed. Disclosed embodiments include a primary fluid flow line deployed between a fluid inlet probe and a fluid outlet line. A fluid analysis module is deployed in the primary fluid flow line. A fluid pumping module including a pump in parallel with a bypass flow line is also deployed in the primary fluid flow line. The bypass flow line includes a bypass valve. A compressible fluid sampling vessel is deployed in parallel with and in fluid communication with the primary flow line. The fluid sampling vessel includes a piston that defines a first sample chamber and a second pressure equalization chamber within the vessel.

A method for obtaining a sample of a compressible downhole fluid includes pumping downhole fluid through the fluid analysis module until a desired fluid purity or property is obtained. To obtain a sample of the fluid, the pump is turned off and the bypass valve is opened thereby enabling the downhole fluid to flow into the fluid sampling vessel. The pump may then be optionally turned back on to pressurize the sample.

The disclosed embodiments may provide various technical advantages. For example, disclosed embodiments may enable a compressible fluid to be efficiently sampled without pressure cycling as can be caused by pumping mechanisms. Moreover, by eliminating such pressure cycling the integrity of the fluid may be maintained.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
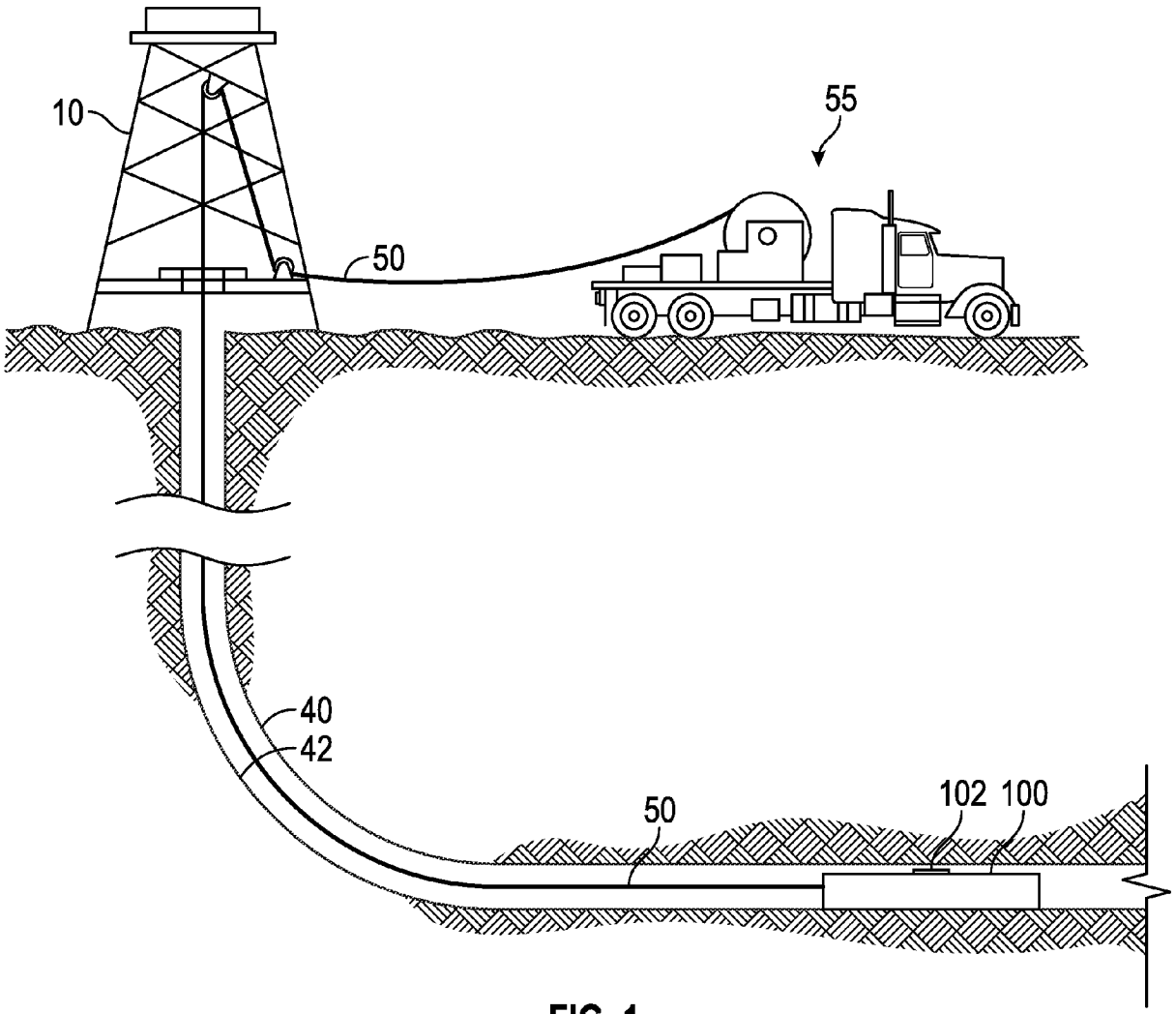
FIG. 1 depicts one example of a drilling rig on which disclosed sampling tool embodiments may be utilized.

FIG. 1 depicts a drilling rig 10 suitable for employing certain wireline tool embodiments disclosed herein. In the depiction, a rig 10 is positioned over (or in the vicinity of) a subterranean oil or gas formation (not shown). The rig may include, for example, a derrick and a hoisting apparatus for lowering and raising various components into and out of the wellbore 40. A downhole sampling tool 100 is deployed in the wellbore 40. The sampling tool 100 may be connected to the surface, for example, via a wireline cable 50 which is in turn coupled to a wireline truck 55.

During a wireline operation, for example, sampling tool 100 may be lowered into the wellbore 40. In a highly deviated borehole, the sampling tool 100 may alternatively or additionally be driven or drawn into the borehole, for example, using a downhole tractor or other conveyance means. The disclosed embodiments are not limited in this regard. For example, sampling tool 100 may also be conveyed into the borehole 40 using coiled tubing or drill pipe conveyance methodologies.

The example sampling tool 100 described herein may be used to obtain samples of compressible formation fluids, for example, those including natural gas or various gas mixtures. The sampling tool 100 may therefore include sample bottles (not shown on FIG. 1) that have various functionality, such as, for example, zero dead volume (flashing line), self-sealing functionality, and/or being nitrogen-charged (as described in more detail below). Sampling tool 100 may further include a probe assembly 102 for establishing fluid communication between the sampling tool 100 and the subsurface formation. During a sampling operation, the probe 26 may be extended into contact with the borehole wall 42 (e.g., through a mud cake layer). Formation fluid samples may be enter the sampling tool 100 through the probe assembly 102 (e.g., via a pumping or via formation pressure).

The probe assembly 102 may include a probe mounted in a frame (the individual probe assembly components are not shown). The frame may be configured to extend and retract radially outward and inward with respect to the sampling tool body. Moreover, the probe may be configured to extend and retract radially outward and inward with respect to the frame. Such extension and retraction may be initiated via an uphole or downhole controller. Extension of the frame into contact with the borehole wall 42 may further support the sampling tool in the borehole as well as position the probe adjacent the borehole wall.

In some embodiments, such as those used in low permeability formations, the probe assembly 102 may be replaced by packer assembly (not shown). The disclosed embodiments are not limited in this regard. As is known to those of ordinary skill in the art, a packer assembly, when inflated, is intended to seal and/or isolate a section of the borehole wall to provide a flow area with which to induce fluid flow from the surrounding formation.

While FIG. 1 depicts a wireline sampling tool 100, it will be understood that the disclosed embodiments are not so limited. For example, sampling tool 100 may include a drilling tool such as a measurement while drilling or logging while drilling tool configured for deployment on a drill string. The disclosed embodiments are not limited in these regards.

Figure 2:
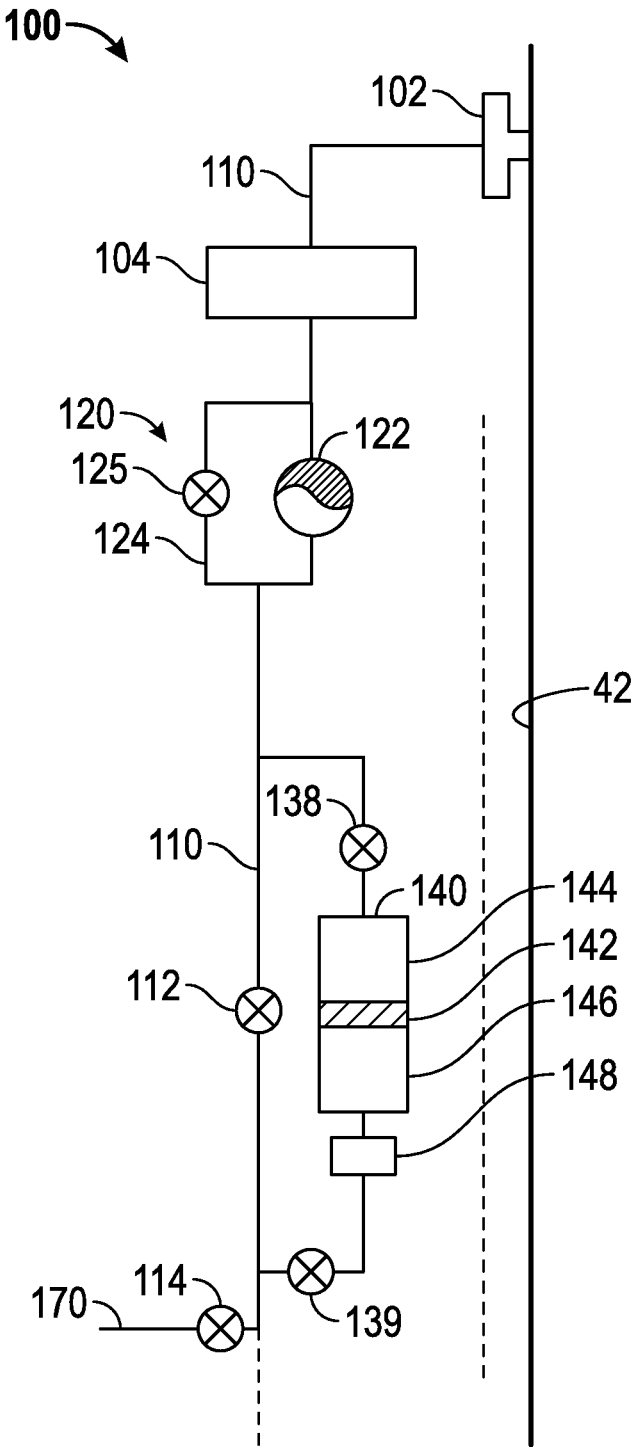
FIG. 2 depicts a downhole sampling tool including a schematic fluid flow circuit diagram.

FIG. 2 further depicts sampling tool 100 including a schematic fluid flow circuit diagram. A probe 102 is depicted as being in contact with borehole wall 42 for obtaining a formation fluid sample. In the depicted embodiment, probe 102 is in fluid communication with a primary flow line 110 including a fluid analysis module 104 and a fluid pumping module 120. The fluid pumping module 120 is in fluid communication with the probe 102 and includes a pump 122 and a bypass flow line 124 (including a bypass valve 125) that are coupled in parallel with one another, for example, as depicted. A sample vessel 140 is in fluid communication with primary flow line 110 and may be configured to receive a formation fluid sample. Sampling tool 100 further includes a fluid outlet line 170 configured for discharging unwanted formation fluid into the annulus or into the subterranean formation.

The probe 102 may be engaged with the borehole wall 42 as depicted so as to establish fluid communication between the subterranean formation and the primary flow line 110 (those of ordinary skill will readily appreciate that the probe may penetrate a mud cake layer on the borehole wall so as to obtain fluid directly from the formation). Examples of probes suitable for use in the in the disclosed embodiments include the Single-Probe Module or Dual-Probe Module included in the Schlumberger MDT® or described in U.S. Pat. Nos. 4,860,581 and 6,058,773, which are fully incorporated by reference herein. While not depicted it will be understood that the probe (or probes) may be coupled to a frame that may be extended and retracted relative to a tool body. In the depicted embodiment, probe 102 is an inlet probe that provides a flow channel from the subterranean formation to the primary flow line 110. Tool 100 may further include one or more outlet probes (e.g., at the downstream end of the fluid outlet line 170) so as to provide a channel through which fluid may flow from the primary flow line 110 out of the tool 100 and back into the formation. In such an embodiment, fluid may be circulated from the formation into the primary flow line 110 and back into the formation.

Fluid analysis module 104 may include substantially any suitable fluid analysis sensors and/or instrumentation, for example, including chemical sensors, optical fluid analyzers, optical spectrometers, nuclear magnetic resonance devices, a conductivity sensor, a temperature sensor, a pressure sensor. More generally, module 104 may include substantially any suitable device that yields information relating to the composition of the formation fluid such as the thermodynamic properties of the fluid, conductivity, density, viscosity, pressure, temperature, and phase composition (e.g., liquid versus gas composition or the gas content) of the fluid. While not depicted, it will be understood that fluid analysis sensors may alternatively and/or additionally be deployed on the downstream side of the fluid pumping module, for example, to sense fluid property changes that may be induced via pumping.

Fluid pumping module 120 may include substantially any suitable pump 122. For example, the pump 122 may include a reciprocating piston pump, a retractable piston pump, or a hydraulic powered pump. In the depicted embodiment pump 122 is configured in a pump-in mode, although as described in more detail below, the disclosed embodiments are no so limited.

Sample vessel 140 includes a piston 142 deployed therein that defines first and second chambers 144 and 146 within the cylindrical vessel 140. The first chamber 144 (the sample chamber) is in fluid communication with the primary flow line (when valve 138 is open) and is for housing a sample of formation fluid. The second chamber 146 (the pressure equalization chamber) may be filled with a fluid such as water, hydraulic fluid, or drilling fluid that is maintained at a desired pressure (e.g., ambient pressure or downhole hydrostatic pressure). The fluid in the second chamber 146 is displaced through a restrictor 148 into the primary flow line 110 when the first chamber 144 is filled with formation fluid.

Figure 3:
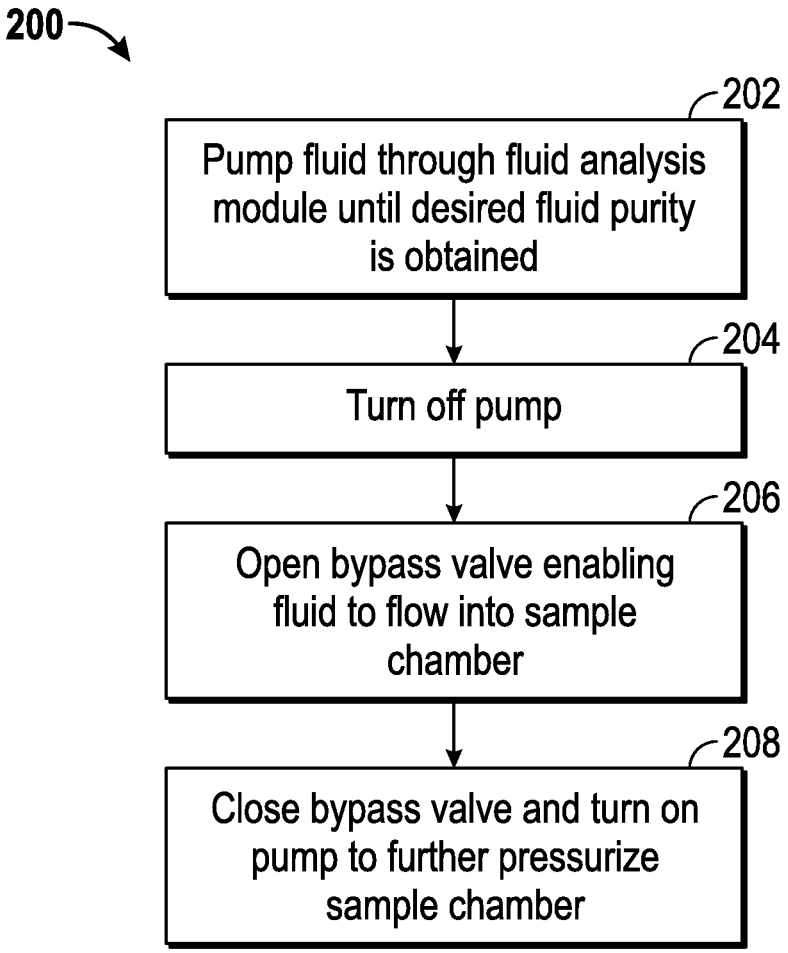
FIG. 3 depicts a flow chart of one disclosed method for obtaining a sample of a compressible formation fluid.

FIG. 3 depicts a flow chart of a method 200 for obtaining a sample of a compressible formation fluid. Method 200 may make use of sampling tool 100 depicted on FIG. 2. Formation fluid may be pumped through a fluid analysis module (e.g., module 104) until a desired fluid purity (or until a desired fluid property) is obtained at 202. Such pumping is intended to obtain virgin formation fluid substantially free of drilling fluid and/or mud cake contamination. While pumping formation fluid through the fluid analysis module valves 125, 138, and 139 may be closed while valves 112 and 114 may be opened so as to provide a fluid passageway from the pump 122 through the primary flow line 110 to the fluid outlet line 170.

After obtaining suitably pure formation fluid (or formation fluid having a measured property suitably close to a desired value), the pump may be shut down at 204. Valves 112 and/or 114 may also be closed as the pump is shut down. The bypass valve 125 (as well as sample vessel valves 138 and 139) may be opened at 206 enabling formation fluid to flow from the probe 102 through the bypass flow line 124 in the pumping module 120 and into the sample chamber 144. The flow of formation fluid into sample chamber 144 urges piston 142 towards the second chamber 146 (downward in the FIG. 2 depiction) causing the fluid in chamber 146 to flow through restrictor 148 and into the primary flow line.

The restrictor 148 is intended to reduce the pressure drop experienced by the formation fluid as it fills sample chamber 144. The restrictor 148 limits the rate at which the pressure equalizing fluid in chamber 146 exits the chamber and therefore also limits the rate at which formation fluid may flow into sample chamber 144. By limiting the fluid flow rates, formation fluid pressure may maintained at near formation pressure. The bypass valve may optionally be closed and the pump turned back on at 208 to pressurize the sample chamber 144 and to obtain a higher mass sample. Upon obtaining the sample, valves 138 and 139 are closed. The downhole tool may then be returned to the surface or remain downhole to perform other operations as desired.

Figure 4:
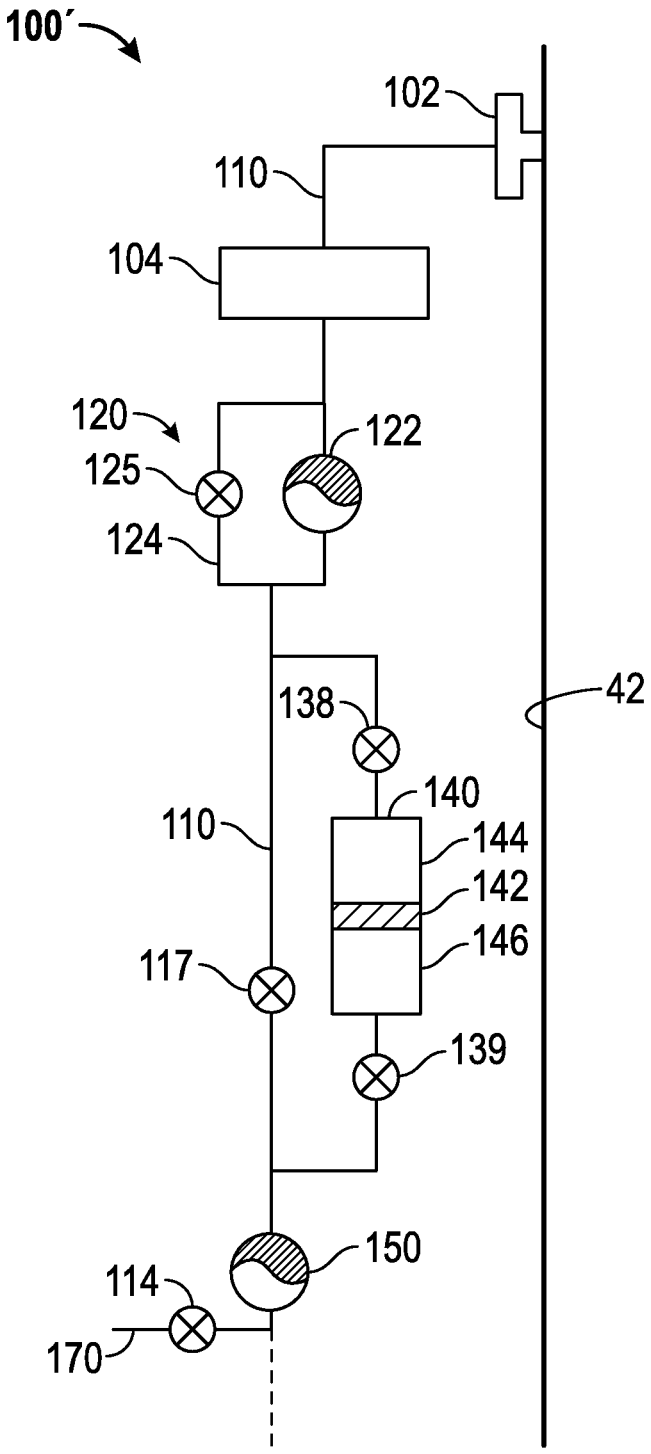
FIG. 4 depicts an alternative downhole sampling tool embodiment including a schematic fluid flow circuit diagram.

FIG. 4 depicts an alternative sampling tool 100' including a schematic hydraulic circuit diagram. Sampling tool 100' is similar to sampling tool 100 in that it includes a probe 102 in fluid communication with a primary flow line 110 including a fluid analysis module 104 and a fluid pumping module 120. As in sampling tool 100 the fluid pumping module 120 is includes a pump 122 and a bypass flow line 124 (including bypass valve 125) which are coupled in parallel with one another. A sample vessel 140 is in fluid communication with primary flow line 110 (when valve 138 is open) and may be configured to receive a formation fluid sample. Sampling tool 100' differs from sampling tool 100 in that it further includes a second pump 150 deployed downstream of the fluid pumping module 120 and the sample vessel 140 and upstream of fluid outlet line 170.

Sampling tool 100' may be used to obtain a formation fluid sample using method 200 depicted on FIG. 3. For example, as described above, formation fluid may be pumped through a fluid analysis module until a fluid having suitable purity or properties is obtained. The pump may then be turned off and the bypass valve opened to provide a fluid sample to the sample chamber. Pump 150 may optionally be employed as a receiver to draw formation fluid into the sample chamber 144, for example, via closing valve 117 and opening valves 125, 138, and 139. The pressure stabilizing fluid in chamber 146 may be pumped through the fluid outlet 170 to the borehole (via opening valve 114) or elsewhere in the tool thereby drawing formation fluid into sample chamber 144.

Figure 5:
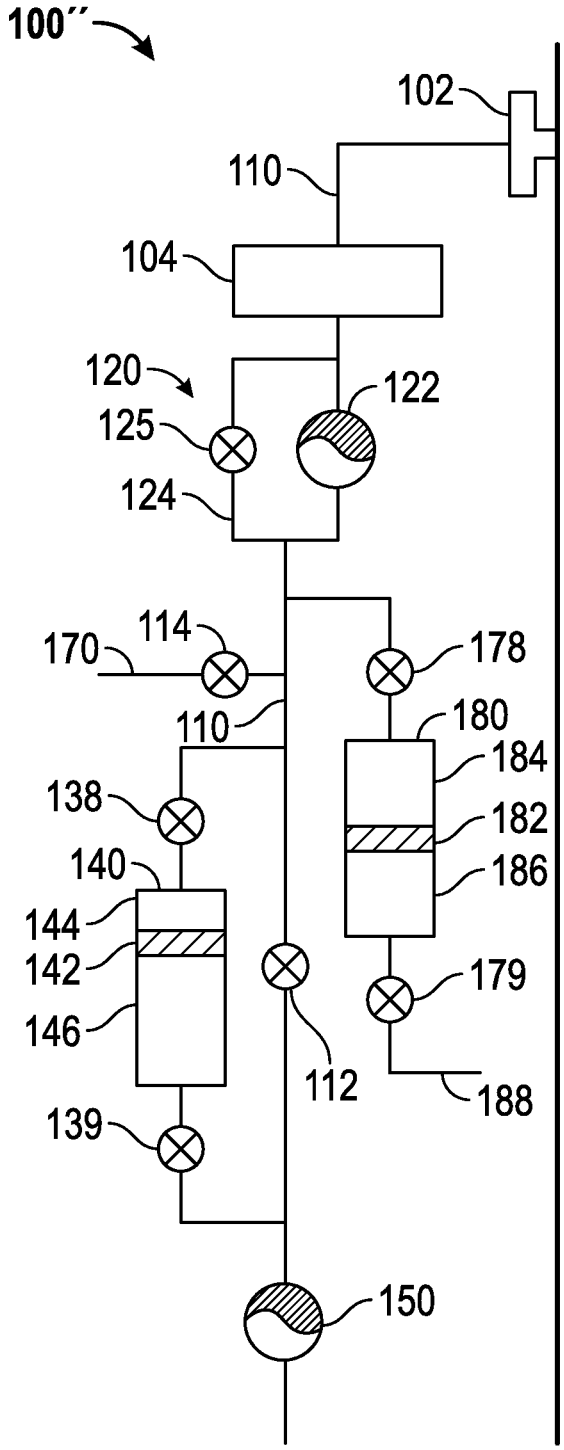
FIG. 5 depicts another alternative downhole sampling tool embodiment including a schematic fluid flow circuit diagram.

FIG. 5 depicts another alternative sampling tool 100" including a schematic hydraulic circuit diagram. Sampling tool 100" is similar to sampling tools 100 and 100' in that it includes a probe 102 in fluid communication with a primary flow line 110 including a fluid analysis module 104 and a fluid pumping module 120. As in sampling tool 100 the fluid pumping module 120 includes a pump 122 and a bypass flow line 124 (including a bypass valve 125) which are coupled in parallel with one another. A sample vessel 140 is in fluid communication with primary flow line 110 (when valve 138 is open) and may be configured to receive a formation fluid sample as described above. Sampling tool 100" is similar to sampling tool 100' in that it further includes a receiving pump 150 for drawing formation fluid into the sample chamber 144 (via pumping pressure stabilizing fluid out of chamber 146).

Sampling tool 100" further includes a second sample vessel 180 configured for receiving a non-compressible fluid sample and hence may be used to obtain either or both of a compressible fluid sample (in sample vessel 140) and a non-compressible fluid sample (in sample vessel 180). Suitable sample vessels for obtaining non-compressible fluids are disclosed in U.S. Pat. No. 7,565,835, which is fully incorporated by reference herein. In the depicted embodiment, sample vessel 180 includes a piston 182 separating the vessel into first and second chambers 184 and 186. The first chamber 184 is in fluid communication with the primary flow line 110 (when valve 178 is open) and configured for receiving the fluid sample. The second chamber 186 is in fluid communication with the borehole via fluid outlet line 188 when valve 179 is open and may be filled, for example, with drilling fluid at hydrostatic pressure. The fluid in the second chamber 186 is displaced through outlet line 188 as the first chamber 184 is filled. The first chamber 184 may receive a fluid sample via opening valves 178 and 179 and pumping (via pump 122) formation fluid into the chamber from the formation through probe 102 and primary flow line 110.

Figure 6:
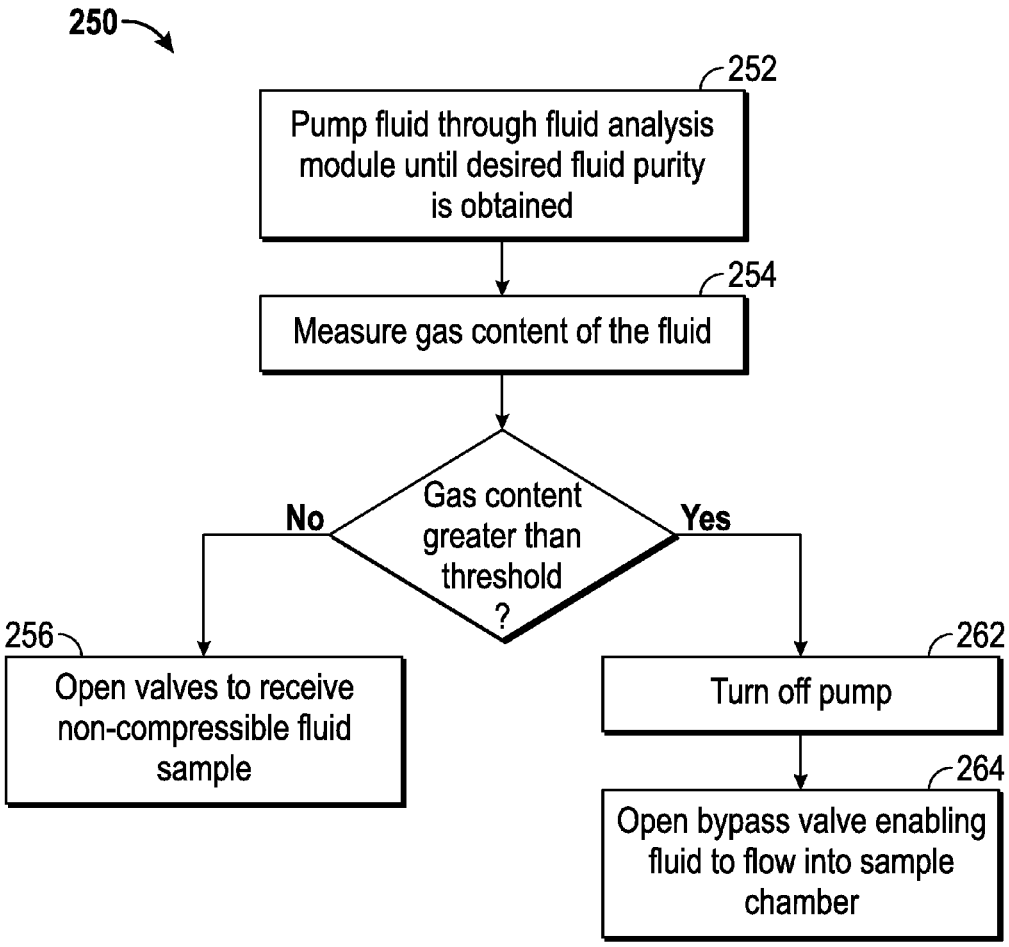
FIG. 6 depicts a flow chart of another disclosed method for obtaining a sample of a compressible and/or a non-compressible formation fluid.

FIG. 6 depicts a method 250 for obtaining a sample of at least one of a compressible formation fluid and a non-compressible formation fluid. Method 250 may make use of sampling tool 100" depicted on FIG. 5. Formation fluid may be pumped through a fluid analysis module (e.g., module 104) until a desired fluid purity (or until a desired fluid property) is obtained at 252. As described above with respect to FIG. 3, such pumping is intended to obtain virgin formation fluid substantially free of drilling fluid contamination. While pumping formation fluid through the fluid analysis module valves 112, 125, 138, 139, 178, and 179 may be closed while valve 114 may be opened so as to provide a fluid passageway from the pump 122 through the primary flow line 110 to the fluid outlet line 170.

Upon obtaining a suitably pure formation fluid (or formation fluid having a measured property suitably close to a desired value), the gas content of the fluid may be measured at 254. When the gas content is below a predetermined threshold, valves 112 and 114 may be closed and valves 178 and 179 opened so as to pump a substantially non-compressible fluid sample into fluid chamber 184 at 256. When the gas content is above the predetermined threshold, the pump may be shut down and valves 112 and/or 114 may be closed at 262. The bypass valve 125 (as well as sample vessel valves 138 and 139) may be opened at 264 enabling formation fluid to flow from the probe 102 through the bypass flow line 124 in the pumping module 120 and into the sample chamber 144. Pump 150 may be employed as a receiver to draw formation fluid into the sample chamber 144 for example via closing valve 117 and opening valves 125, 138, and 139. The pressure stabilizing fluid in chamber 146 may be pumped through the fluid outlet 170 to the borehole (via opening valve 114) or elsewhere in the tool.

It will be understood that disclosed sampling tools may include sampling bottles having functionality. For example, the bottles may be configured to eliminate or 'zero' dead volume contained therein. Dead volume is a term used to indicate the volume that exists between the seal valve at the inlet to a sample cavity, such as, for example, a sample bottle, of a sample chamber and the sample cavity itself. In operation, this volume is typically filled with a fluid, gas and/or a vacuum. Likewise, the sample chambers in the rest of the flow system are filled with a fluid, gas and/or a vacuum. However, a vacuum is undesirable in many instances because a large pressure drop may result when the seal valve is opened. Thus, many high quality samples may be taken using "low shock" techniques wherein the dead volume is almost always filled with a fluid, usually water. This fluid is often swept into and/or mixed with the formation fluid when a sample is collected, thereby contaminating the sample. Moreover, determination that a sample bottle is full may be obtained, for example, by monitoring the flowline pressure.

The sample bottles may further have self-sealing functionality. A bottle with a self-sealing mechanism prevents fluid from entering therein when a probe or other tool is detached from the downhole sampling tool. The self-sealing mechanism may be configured so as to withstand a high mud flow rate in a mud channel encountered in a wellbore.

Sampling bottles may also be nitrogen-charged. Nitrogen charging may manipulate the pressure within a sampling chamber or bottle. After the successful capture of the sample, the piston causes the sample flow line to be obstructed to seal the fluid sample inside the sample bottle. The sample is then maintained at or above reservoir pressure during retrieval by the release of a pre-set nitrogen charge. The nitrogen in the bottle may exert pressure onto the sample. The pressure is created through a floating piston acting on a buffer fluid, such as, for example, synthetic oil, thus avoiding nitrogen contamination of a sample. The recovery pressure may be set at several thousand psi (or hundred MPa) above the bubble point pressure. In the case of asphaltene studies, the recovery pressure may be set above the reservoir pressure.

Although a downhole sampling tool for obtaining a compressible fluid and certain advantages thereof have been described in detail, it should be understood that various changes, substitutions and alternations can be made herein without departing from the spirit and scope of the disclosure as defined by the appended claims.

What is claimed is:

1. A method for obtaining a sample of a compressible downhole fluid, the method comprising:

(a) deploying a downhole sampling tool in a subterranean borehole, the sampling tool including fluid analysis module, a fluid pumping module including a bypass valve in parallel with a pump, and a fluid sampling vessel deployed downstream of the fluid pumping module;

(b) pumping downhole fluid through the fluid analysis module until a desired fluid purity or property is obtained;

(c) turning off the pump;

(d) opening the bypass valve thereby enabling the downhole fluid to flow into the fluid sampling vessel;

(e) closing the bypass valve; and (f) turning on the pump to further pressurize the downhole fluid in the fluid sampling vessel.

2. The method of claim 1, further comprising:

(g) turning on a second pump located downstream of the fluid sampling vessel to draw the downhole fluid into the fluid sampling vessel.

3. The method of claim 1, wherein (d) further comprises opening first and second valves located upstream and downstream of the fluid sampling vessel.

4. The method of claim 1, wherein (d) further comprises restricting a flow rate of the downhole fluid into the sampling vessel.

5. A method for obtaining at least one of a compressible and a non-compressible fluid, the method comprising:

(a) deploying a downhole sampling tool in a subterranean borehole, the sampling tool including fluid analysis module, a fluid pumping module including a bypass valve in parallel with a pump, and first and second fluid sampling vessels both deployed downstream of the fluid pumping module;

(b) pumping downhole fluid through the fluid analysis module until a desired fluid purity or property is obtained;

(c) measuring a gas content of the downhole fluid;

(d) comparing the gas content measured in (c) with a predetermined threshold;

(e) pumping downhole fluid into the first fluid sampling vessel when the gas content is less than the predetermined threshold; and (f) turning off the pump and opening the bypass valve thereby enabling the downhole fluid to flow into the second fluid sampling vessel when the gas content is greater than the predetermined threshold; wherein (f) further comprises closing the bypass valve and turning on the pump to further pressurize the downhole fluid in the second fluid sampling vessel.

6. The method of claim 5, wherein (f) further comprises turning on a second pump located downstream of the second fluid sampling vessel to draw the downhole fluid into the second fluid sampling vessel.

7. The method of claim 5, wherein (f) further comprises opening first and second valves located upstream and downstream of the second fluid sampling vessel.

8. The method of claim 5, wherein (f) further comprises restricting a flow rate of the downhole fluid into the second fluid sampling vessel.

* * * * *